US009624735B2

(12) United States Patent
Pezet et al.

(10) Patent No.: US 9,624,735 B2
(45) Date of Patent: Apr. 18, 2017

(54) MARINE DRILLING RISER PROTECTION SYSTEM

(71) Applicant: Matrix Composites & Engineering Ltd., Wattleup (AU)

(72) Inventors: Peter Brendon Thomas Pezet, Padbury (AU); Aaron Paul Begley, Dalkeith (AU)

(73) Assignee: Matrix Composites & Engineering Ltd., Wattleup (AU)

( * ) Notice: Subject to any disclaimer, the term of this patent is extended or adjusted under 35 U.S.C. 154(b) by 0 days.

(21) Appl. No.: 14/550,274

(22) Filed: Nov. 21, 2014

(65) Prior Publication Data

US 2016/0145948 A1 May 26, 2016

(51) Int. Cl.

| | |
|---|---|
| ***F15D 1/10*** | (2006.01) |
| ***F16L 1/20*** | (2006.01) |
| ***E02D 5/60*** | (2006.01) |
| ***B63B 51/02*** | (2006.01) |
| ***E21B 29/12*** | (2006.01) |
| ***E21B 17/01*** | (2006.01) |

(52) U.S. Cl.
CPC ..... *E21B 17/01* (2013.01)

(58) Field of Classification Search
None
See application file for complete search history.

(56) References Cited

U.S. PATENT DOCUMENTS

| | | | | |
|---|---|---|---|---|
| 6,270,387 | B1 * | 8/2001 | Nesheim | E21B 17/012 405/211 |
| 6,755,595 | B2 * | 6/2004 | Oram | E21B 17/01 114/243 |
| 7,214,114 | B2 * | 5/2007 | Gibson | E21B 17/012 441/133 |
| 2002/0146287 | A1 * | 10/2002 | Allen | B63B 21/502 405/211 |

* cited by examiner

*Primary Examiner* — Matthew R Buck
*Assistant Examiner* — Douglas S Wood
(74) *Attorney, Agent, or Firm* — Fish & Richardson P.C.

(57) ABSTRACT

A marine drilling riser protection system including a plurality of protection modules adapted for fitment at spaced intervals along the length of a riser, and a plurality of cover parts, wherein each cover part is adapted to be fitted at one end of the cover part to a first protection module, and at an opposite end of the cover part to a second protection module.

17 Claims, 16 Drawing Sheets

MARINE DRILLING RISER PROTECTION SYSTEM

FIELD OF THE INVENTION

The invention relates to a marine drilling riser protection system and, more particularly, but not exclusively, to a marine drilling riser protection system having manually interchangeable compact buoyant protection modules.

BACKGROUND OF THE INVENTION

A marine drilling riser is a large-diameter pipe that connects a subsea blowout preventer (BOP) stack to a floating surface rig to take mud returns to the surface. Without the riser, the mud would simply spill from the top of the stack onto the seafloor.

The riser has a significant weight which is supported by its own structure and the surface rig. To reduce the weight of the riser acting on the rig, it is known to provide drill riser buoyancy modules along the length of the riser. However, the applicant has determined that in the storage, handling and deployment of drilling risers, there is often mechanical damage inflicted upon the buoyancy and, in cases where riser joints have no buoyancy, damage to the auxiliary lines or pipes of the riser itself. Furthermore, the applicant has determined that existing riser joints may be damaged during stacking and/or may not stack well.

Covers for buoyancy modules have previously been suggested, however, assembly and securement of these covers to the buoyancy modules has not been ideal. In this regard, it is desirable that the covers are easily fixable to the buoyancy modules in a secure manner and offer a flush finish free from snagging edges.

Examples of the invention seek to provide an improved marine drilling riser protection system which overcomes or at least alleviates disadvantages associated with existing systems.

SUMMARY OF THE INVENTION

In accordance with one aspect of the present invention, there is provided a marine drilling riser protection system including a plurality of protection modules adapted for fitment at spaced intervals along the length of a riser, and a plurality of cover parts, wherein each cover part is adapted to be fitted at one end of the cover part to a first protection module, and at an opposite end of the cover part to a second protection module.

Preferably, each of the protection modules is buoyant. More preferably, the system is adapted to be tailored to a desired buoyancy by attaching protection modules along the riser in greater density of relative location (ie. in greater concentration) to increase buoyancy, and by attaching protection modules along the riser in lower density of relative location (ie. in lower concentration) to decrease buoyancy. Where the protection modules are buoyant, they may each be formed to have a density less than the density of sea water (or less than approximately 1000 kg per cubic meter).

Alternatively, the protection modules may be non-buoyant. Where the protection modules are non-buoyant, they may each be formed to have a density greater than the density of sea water (or greater than approximately 1000 kg per cubic meter). This may be desirable for operators who prefer slick joints (which are generally located on the bottom of a riser string) to actually be ballasted. This can give greater control of the string when deploying or retrieving, especially in strong currents.

Even more preferably, each of the protection modules is adapted to be axially fixable to the riser at any location along the length of the riser. Still more preferably, each of the protection modules is adapted to be clamped to the riser so as to axially fix the protection module relative to the riser.

Preferably, any distances between two neighbouring protection modules above a threshold distance are spanned with one of said cover parts fitted between said two neighbouring modules. More preferably, any distances between two neighbouring modules below said threshold distance are left uncovered by a cover part.

Preferably, the threshold distance is selected such that a substantially flush finish is achieved along a length of the riser by having throughout the length of the riser protection modules either (i) mutually adjacent or (ii) mutually spaced with spaces between the protection modules covered with a cover part. More preferably, a substantially flush finish is achieved, with a generally circular cross-section such that riser joints can be stacked and deployment snags reduced.

Preferably, the protection modules are sized to allow drilling operators to manually remove or add protection modules as required during a drilling campaign without requiring a shore-based dressing operation.

In a preferred form, each of the protection modules has an axial length approximately the same as an outer diameter of the protection module. More preferably, the ratio of axial length of the protection module to the outer diameter of the protection module is between 0.5 and 1.5.

Preferably, each of the protection modules is non-free-flooding. More preferably, each of the protection modules is formed as a solid body, without an internal free-flooding cavity. In one particular form, each of the protection modules is formed from a solid material. The solid material may have a density of less than 1000 kg per cubic meter for buoyancy or greater than 1000 kg per cubic meter for non-buoyancy.

Preferably, each of the covers when mounted remains spaced from the riser. More preferably, each of the cover parts when mounted remains spaced from the riser by the protection modules to which the respective cover part is mounted.

According to a preferred embodiment, at least one of the cover parts has at least one engagement member configured for releasable engagement with the protection modules. Preferably, the or each cover part is configured to receive a securement device, said device being configured to secure the cover part(s) to the protection module and the protection module to the riser. Preferably, the or each engagement member is an angled peripheral edge extending from the cover part(s) and configured to engage a corresponding portion of the protection module(s) to fix the cover part to the protection module in use.

The or each cover part can have a recess in which the securement device can be received. Preferably, the or each protection module has a recess formed therein, in which an underside of the recess of the cover parts can be received.

Preferably, the securement device includes a strap and tensioner for tensioning said strap. Preferably, a recess is formed in the protection module for receiving the tensioner and an aperture is formed in the cover parts, through which the tension can be accessed.

Preferably, the cover parts further comprise at least one aperture through which the riser and/or protection module can be viewed and/or accessed.

According to preferred embodiments, at least some of the cover parts are semi-cylindrical and configured so that pairs of cover parts cooperate to substantially surround a portion of the riser.

Preferably, a portion of the peripheral edge extending along a curved edge of the cover part is formed with a return extending inwardly toward the riser. More preferably, the return is substantially perpendicular to a longitudinal axis of the riser.

According to preferred embodiments, the engagement member includes a return or hooked portion extending from and along at least a portion of a generally straight edge of the cover part, the hooked portion configured to be received in a longitudinally extending slot formed on the protection module to secure the cover part to the protection module.

Preferably, the cover parts are formed with a plurality of apertures to facilitate flooding or drainage of a cavity formed behind the cover parts.

In accordance with another aspect of the present invention, there is provided a method of tailoring buoyancy of a marine drilling riser protection system including the steps of:

attaching a plurality of buoyant protection modules along the length of a riser;

increasing a density of relative location (concentration) of the buoyant protection modules along the length of the riser to increase the buoyancy of the system; and decreasing a density of relative location (concentration) of the buoyant protection modules along the length of the riser to decrease the buoyancy of the system.

Preferably, the method further includes the step of attaching cover parts to span any spaces between neighbouring protection modules, each cover part being fitted at one end of said cover part to a first neighbouring protection module, and being fitted at an opposite end of said cover part to a second neighbouring protection module.

Covers can also span over buoyant modules to provide a sacrificial cover to prevent/reduce running or storage damage to the buoyant modules.

BRIEF DESCRIPTION OF THE DRAWINGS

The invention is described, by way of non-limiting example only, with reference to the accompanying drawings, in which.

DETAILED DESCRIPTION

Figure 1:
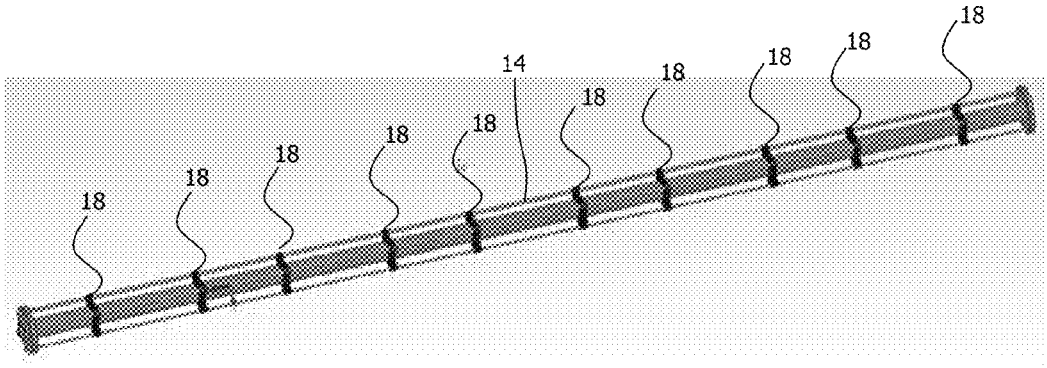
FIG. 1 is a side perspective view of a bare riser joint with riser clamps.

With reference to FIGS. 1 to 9, there is shown a marine drilling riser protection system 10 which protects a drilling riser, protects buoyancy of the drilling riser, may be adapted to efficiently change the degree of buoyancy of the drilling riser, and allows good stacking of drilling riser joints.

More specifically, the marine drilling riser protection system 10 in accordance with the example depicted in the drawings includes a plurality of protection modules 12 adapted for fitment at spaced intervals along the length of a drilling riser 14, and a plurality of cover parts 16. Each cover part 16 is adapted to be fitted at one end of the cover part 16 to a first protection module 12*a*, and at an opposite end of the cover part 16 to a second protection module 12*b*.

Figure 2:
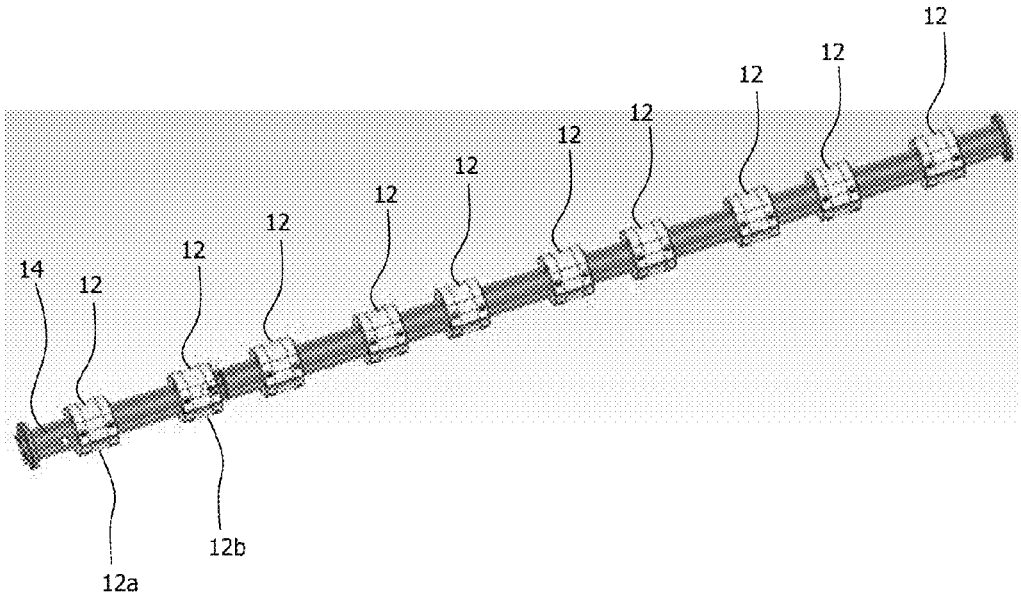
FIG. 2 is a side perspective view of the riser joint shown with small protection modules fitted at each clamp location.

More specifically, FIG. 1 shows a bare riser joint (grey) 14 with riser clamps (black) 18, and FIG. 2 shows the riser joint 14 shown with small protection modules 12 fitted at each clamp location. Advantageously, the system comprises a number of small, discrete modules, with a similar profile to that of buoyancy modules, located along the length of the riser joint 14. Typically, the protection modules 12 may be located at every riser clamp location, however the protection modules 12 may also be located at other locations along the length of the riser joint 14.

Each of the protection modules 12 may be buoyant so as to reduce the weight of the drilling riser 14 carried by the surface rig. The system 10 is adapted to be tailored to a desired buoyancy by attaching protection modules 12 along the riser 14 in greater density of relative location (concentration) to increase buoyancy, and by attaching protection modules along the riser 14 in lower density of relative location (concentration) to decrease buoyancy. In other words, with reference to FIG. 2, if greater buoyancy is desirable the protection modules 12 may be fitted to the riser 14 at additional locations to those shown, and if reduced buoyancy is required one or more of the protection modules 12 shown may be removed.

Figure 3:
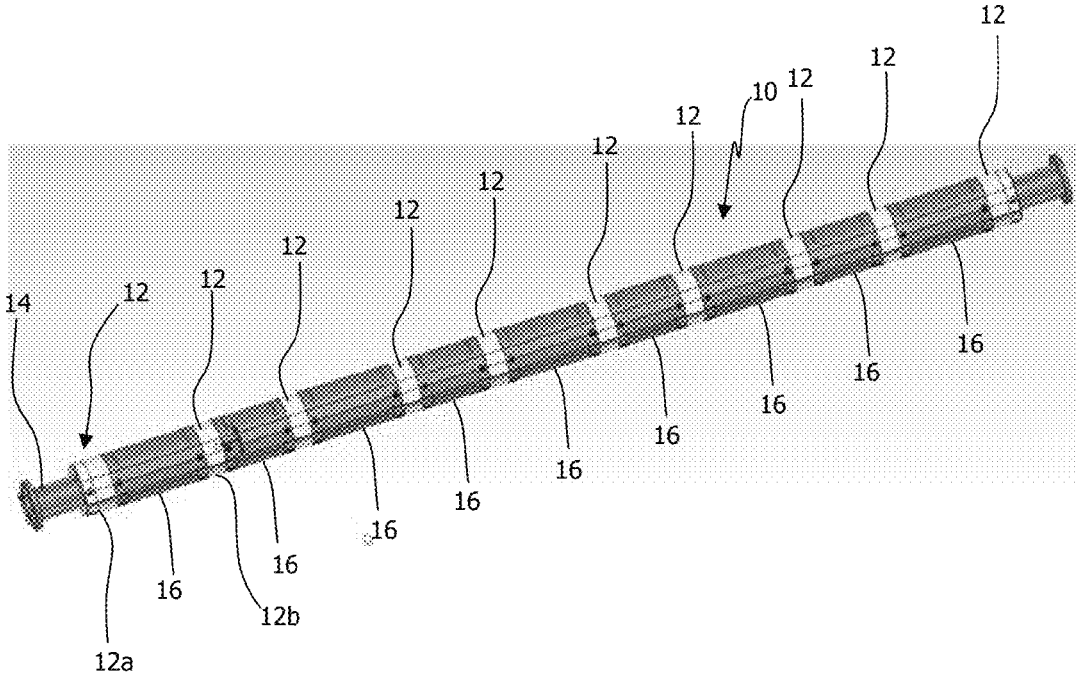
FIG. 3 is a side perspective view of the riser joint shown fitted with protection modules and cover parts.
Figure 4:
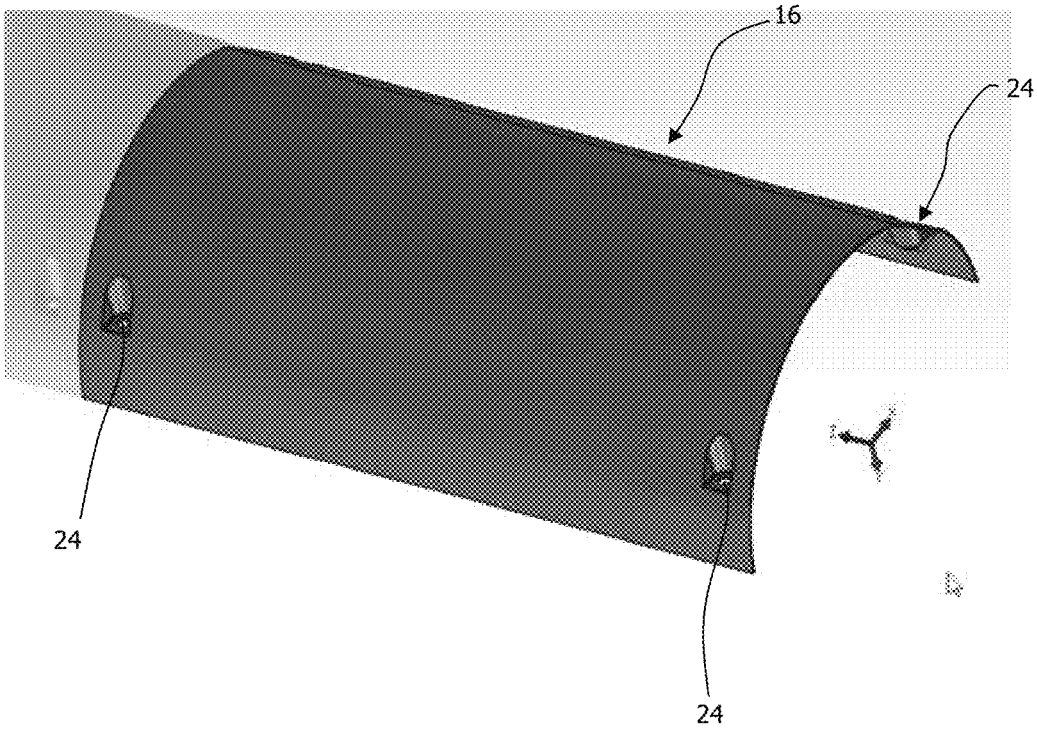
FIG. 4 is a side perspective view of a cover part.
Figure 5:
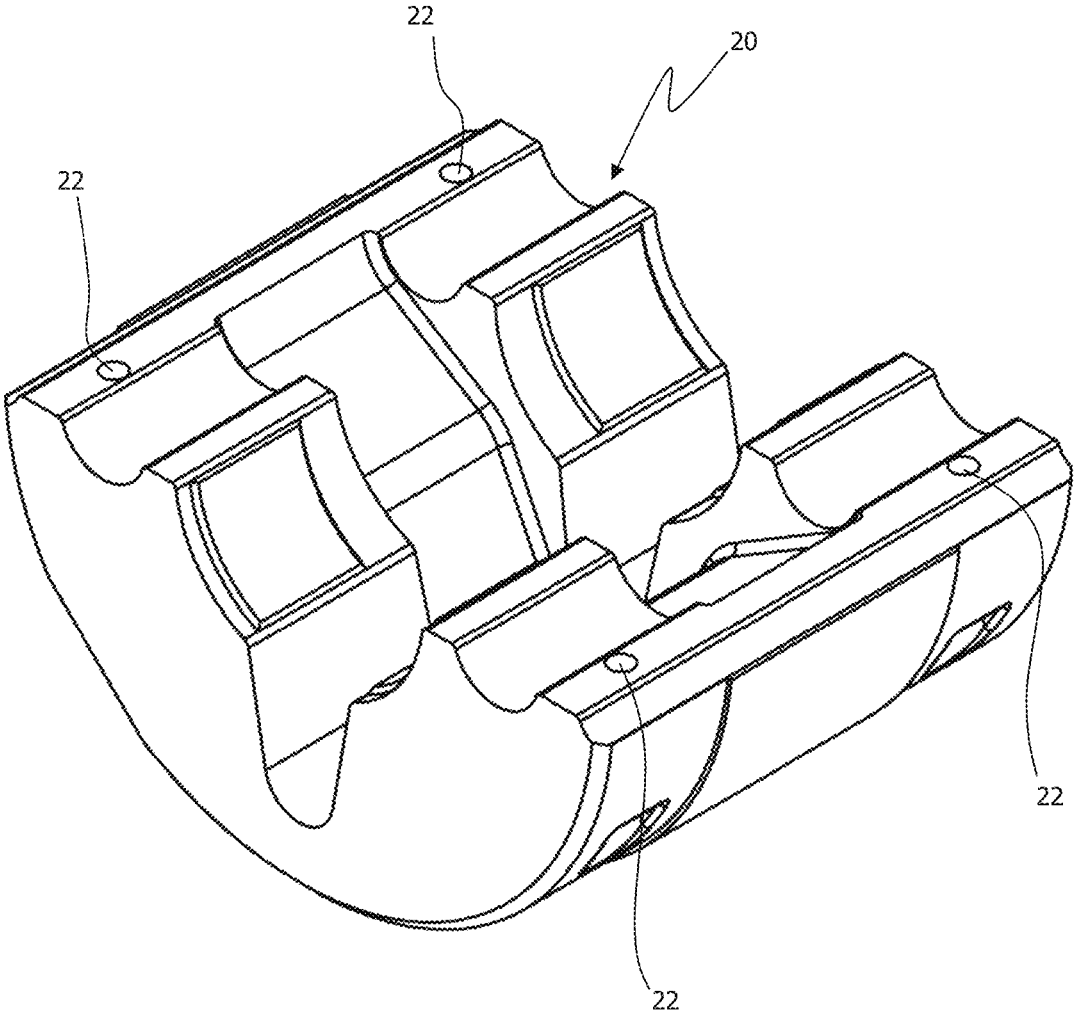
FIG. 5 is an upper perspective view of part of a protection module.
Figure 6:
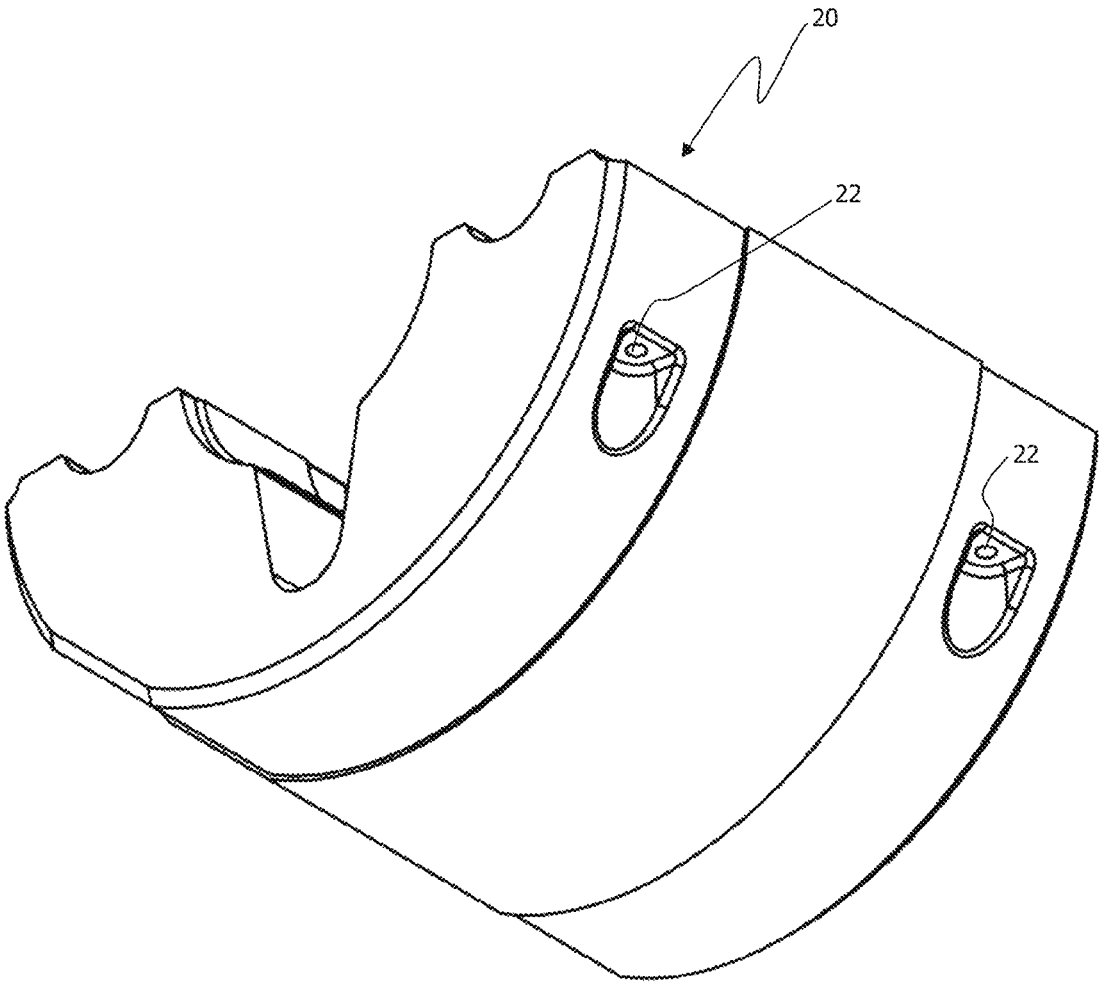
FIG. 6 is a lower perspective view of the protection module part.
Figure 7:
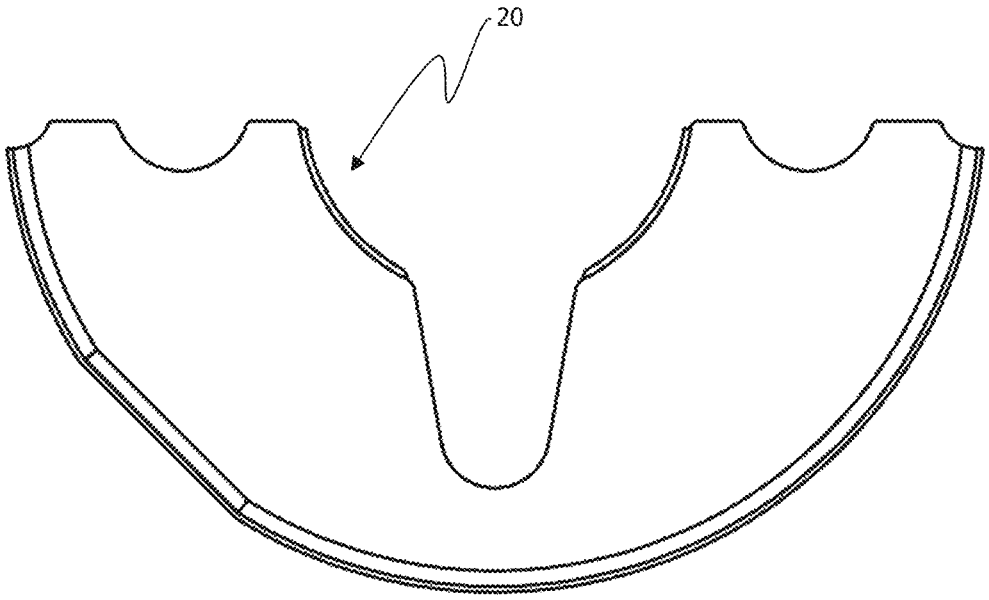
FIG. 7 is an end view of the protection module part.
Figure 8:
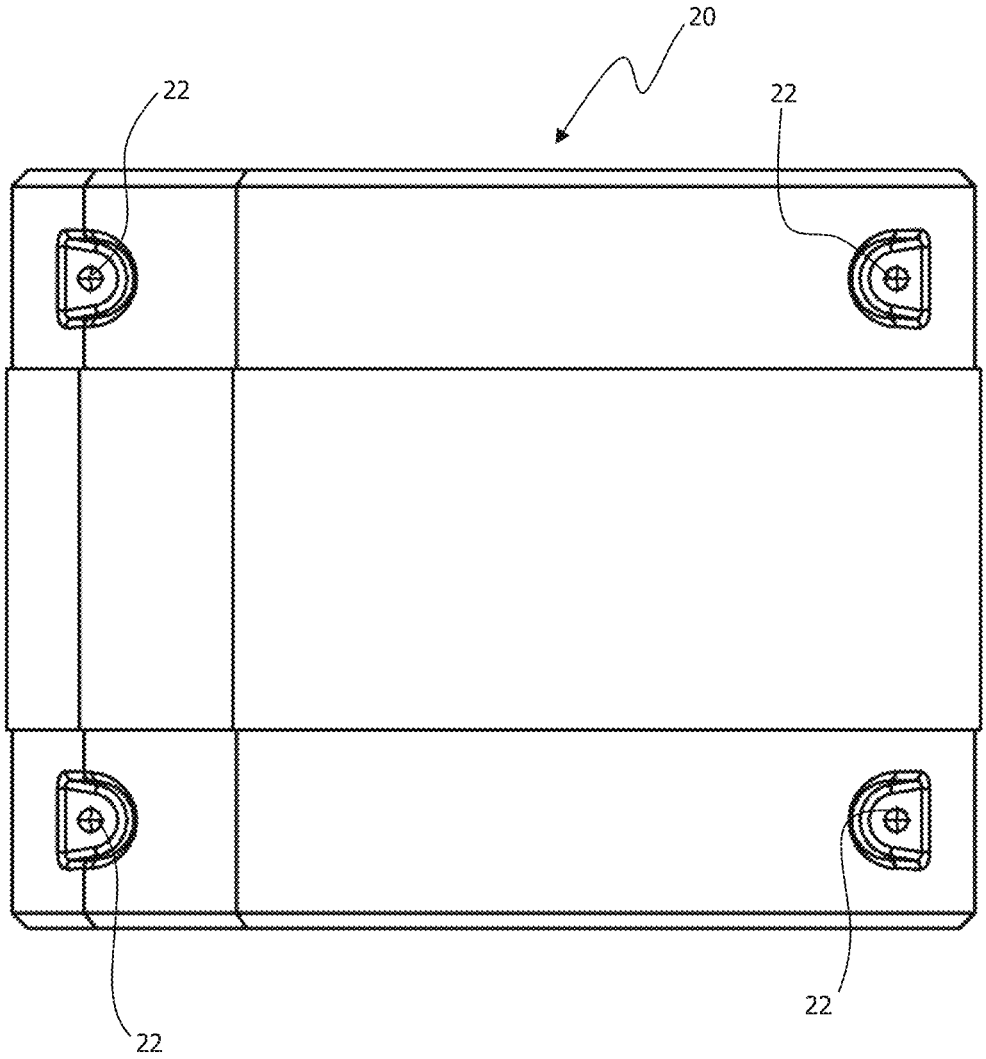
FIG. 8 is a bottom view of the protection module part.
Figure 9:
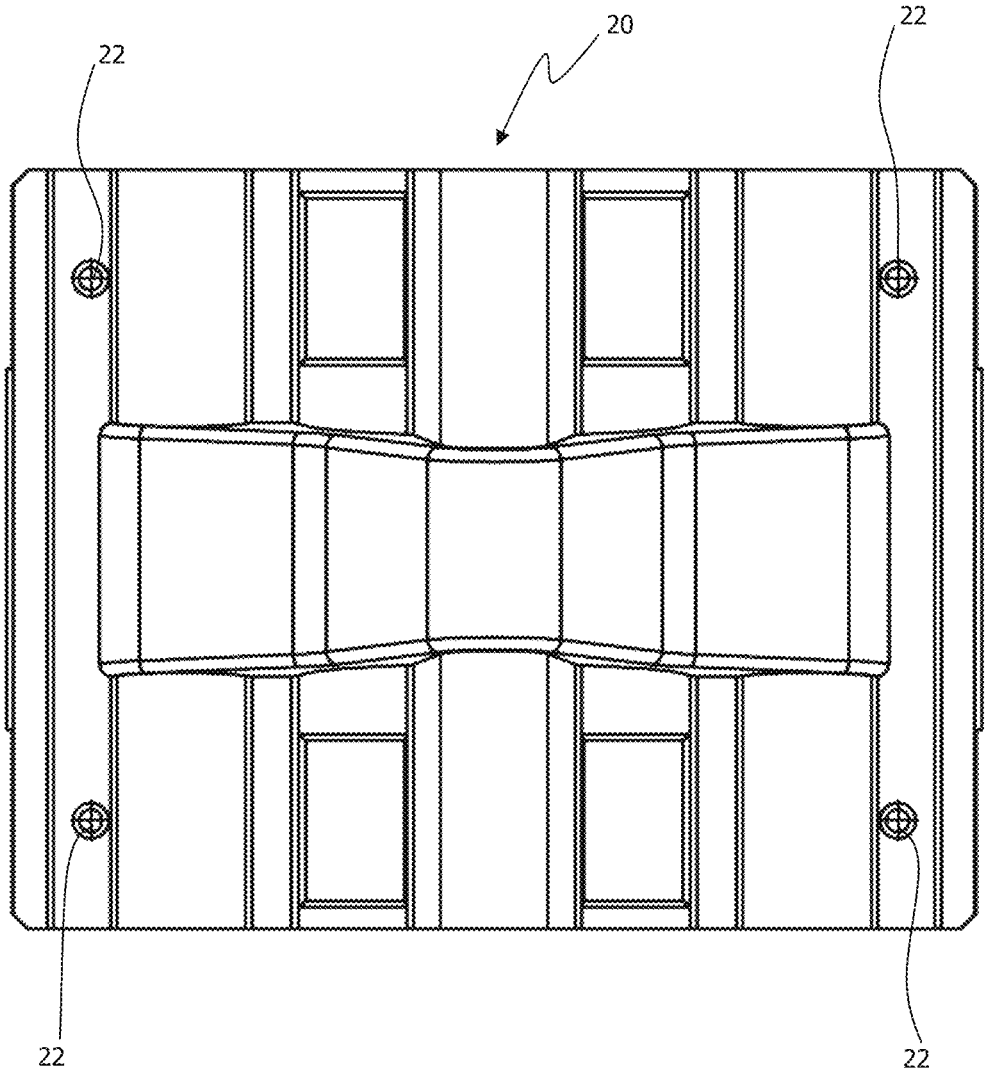
FIG. 9 is a top view of the protection module part.
Figure 13:
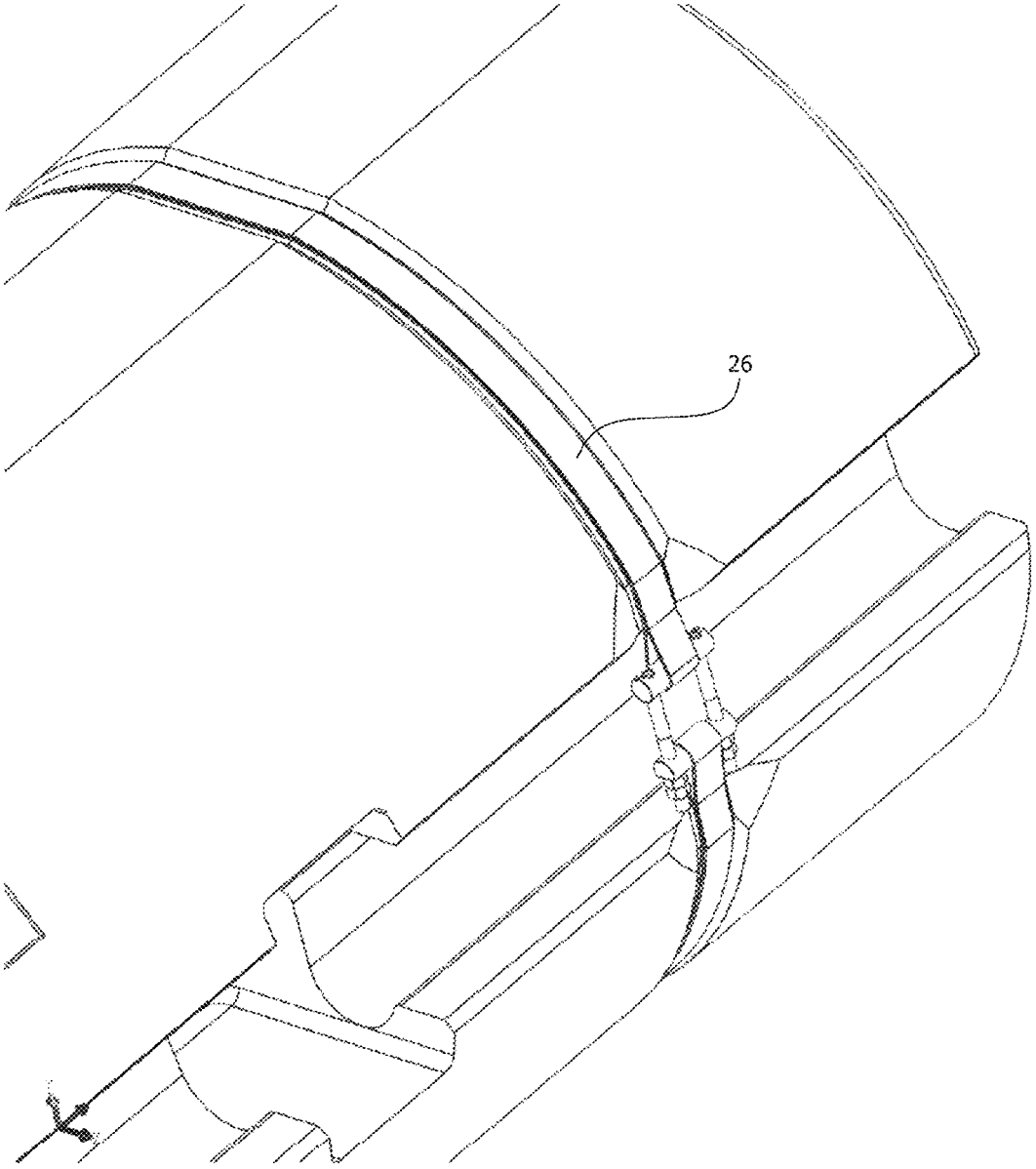
FIG. 13 shows a protection module fixed in place with a strap.
Figure 14:
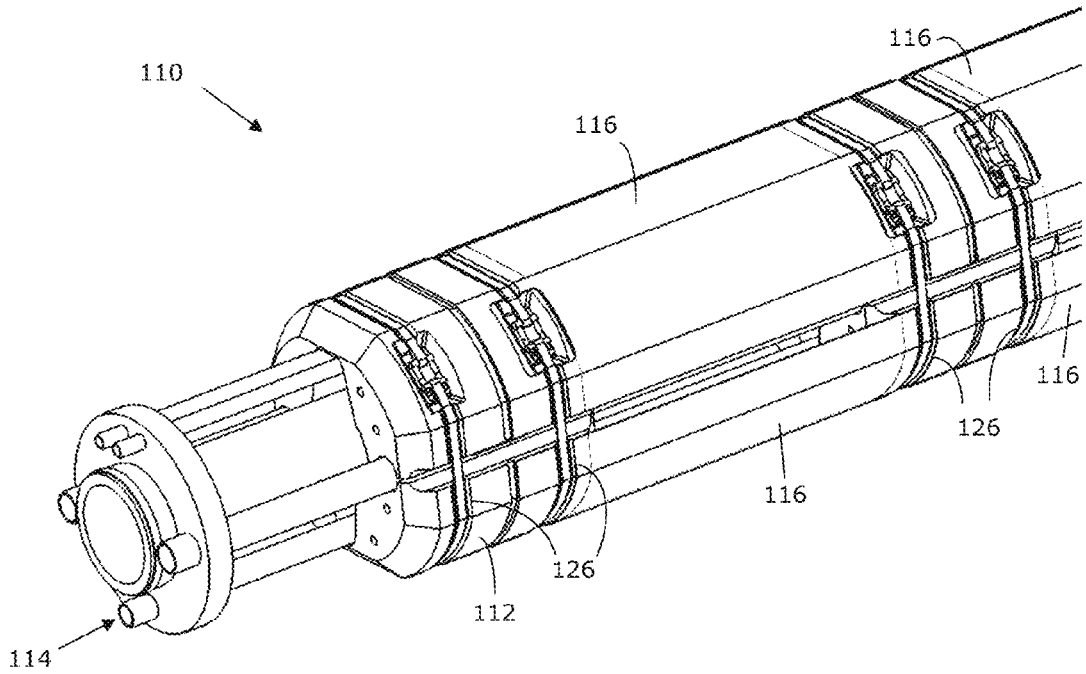
FIG. 14 shows another marine drilling riser protection system fitted to a marine drilling riser.
Figure 15:
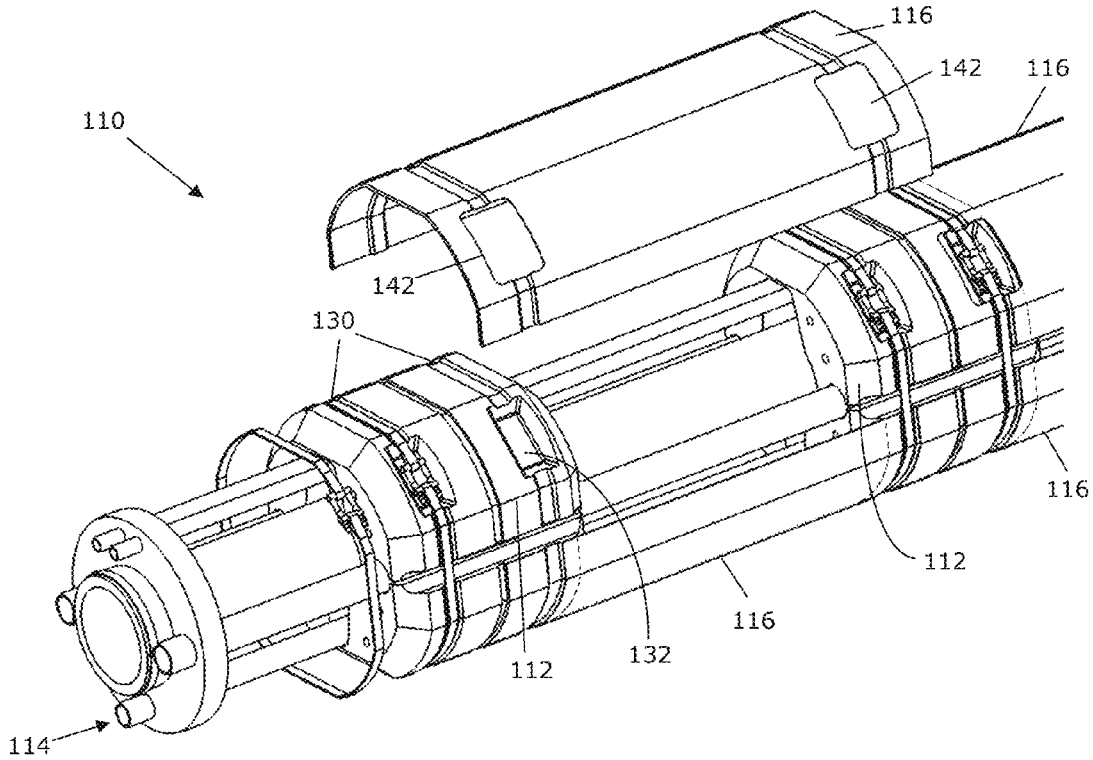
FIG. 15 shows the system of FIG. 14 partially disassembled.
Figure 16:
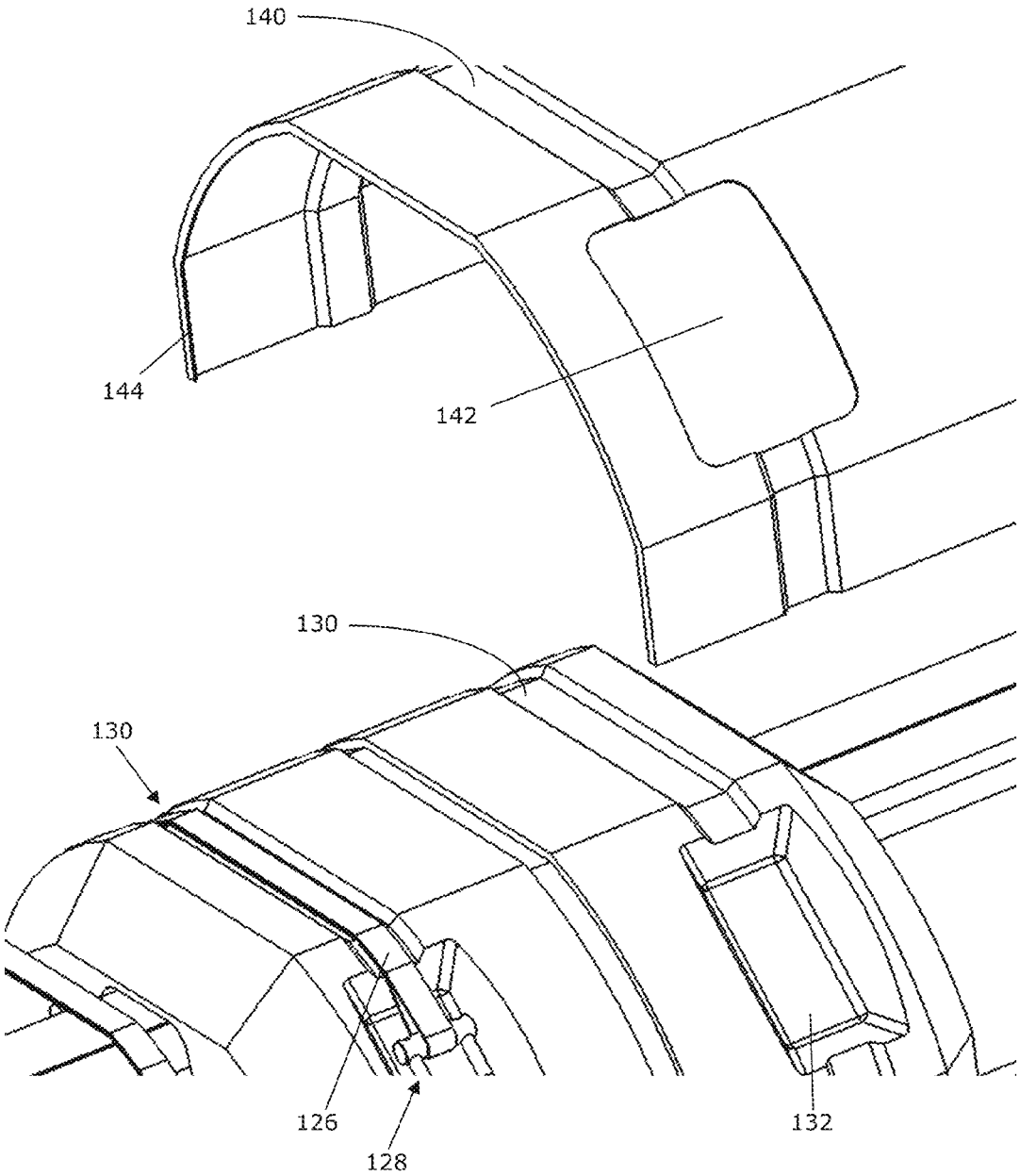
FIGS. 16 and 17 are respective close views of the system shown in FIGS. 15 and 14.
Figure 17:
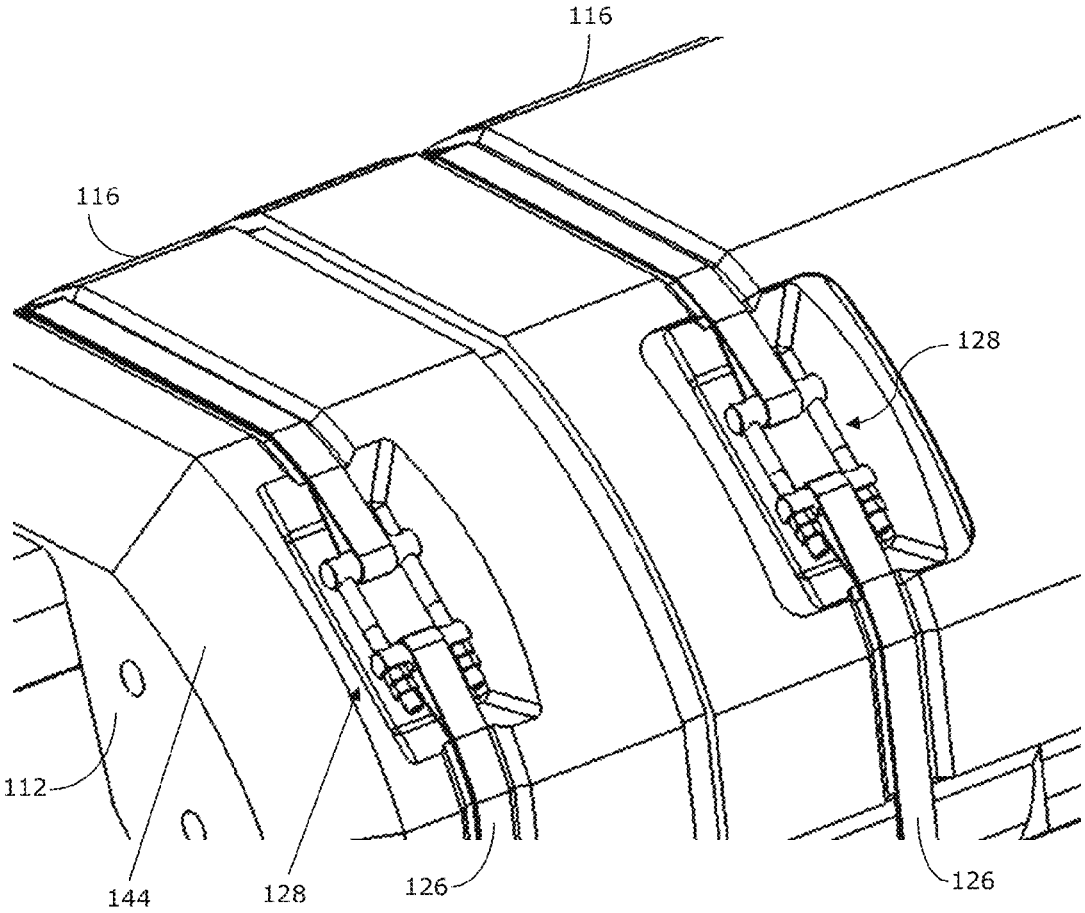
Figure 18:
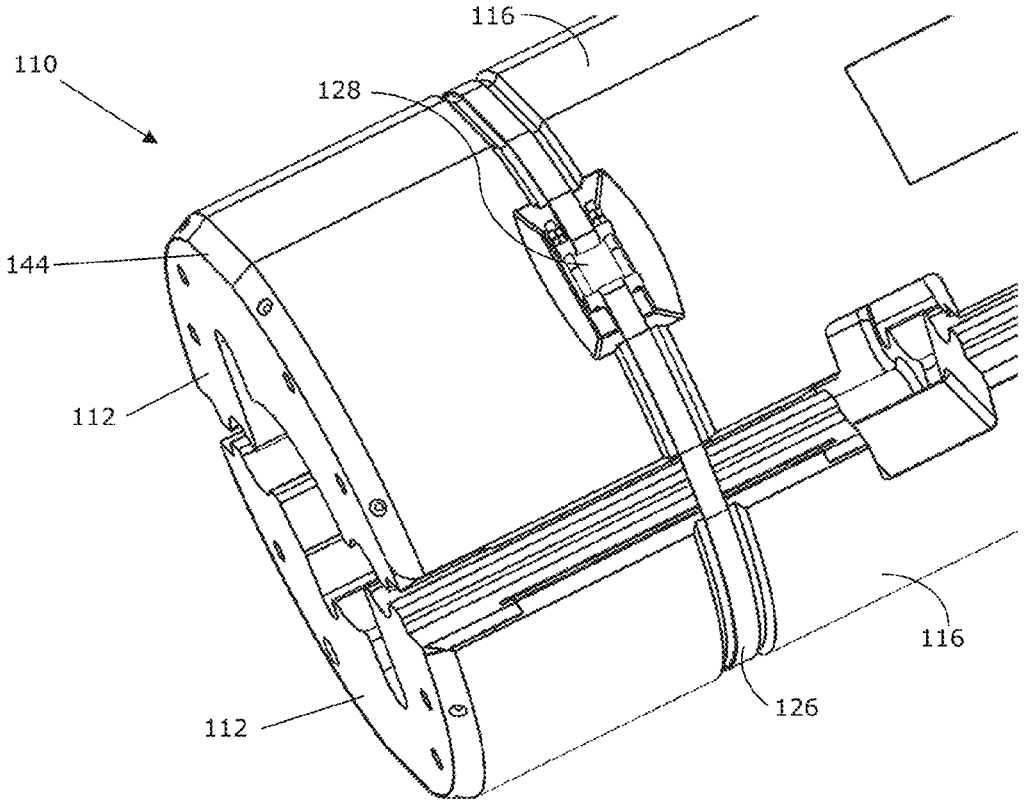
FIG. 18 is a perspective view of an alternative cover part fitted to a protection module.
Figure 19:
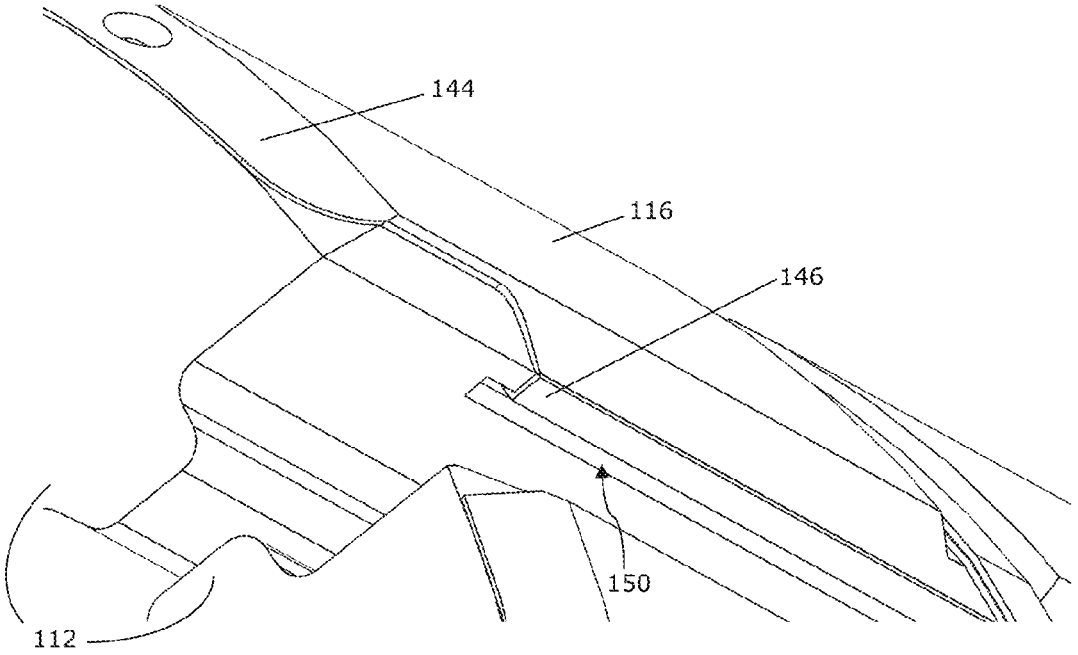
FIG. 19 is a close perspective view of the cover part and module of FIG. 18, showing in more detail the engagement between the cover part and the module.

To facilitate the tailoring of the system 10, each of the protection modules 12 is adapted to be axially fixable to the riser 14 at any location along the length of the riser 14. This may be achieved by each of the protection modules 12 being adapted to be clamped to the riser 14 so as to axially fix the protection module 12 relative to the riser 14. Each of the protection modules 12 may comprise a pair of like protection module parts 20, a single one of which is shown in FIGS. 5 to 9. The protection module parts 20 may be fitted together around the riser 14 with bolts (or ties/straps 26—see FIG. 13) to hold together the parts 20. Where a strap 26 is used, the strap 26 may be provided with a tensioner. If bolts are used, they may be inserted through apertures 22 so that the parts 20 can be fastened together and clamped against axial displacement along the riser 14. As shown in FIG. 4, each cover part 16 may also be provided with recessed apertures 24 to enable the cover parts 16 to be fastened to protection modules 12 at either end. The recessed apertures 24 may be configured so as to leave a gap between the cover parts 16 and the protection modules 12 to provide further protection to the protection modules 12 in the event that the cover parts 16 are dinted inwardly. When the cover parts 16 are fastened to the protection modules 12 at either end, the cover parts 16 overlap the protection modules 12 as shown in FIG. 3. The cover parts 16 may be of different lengths, as shown in FIG. 3.

The protection modules 12 may be of varying sizes. In embodiments where the protection module 12 is of the same length as the riser joint 14, a cover part 16 will overlie and protect the module 12 along its length. In other embodiments, smaller protection modules, both buoyant and non-buoyant, that are spaced apart may be provided and the cover part 16 the gap between the modules. In other embodiments, the joint may be configured to receive a cover part without a protection module.

Figure 10:
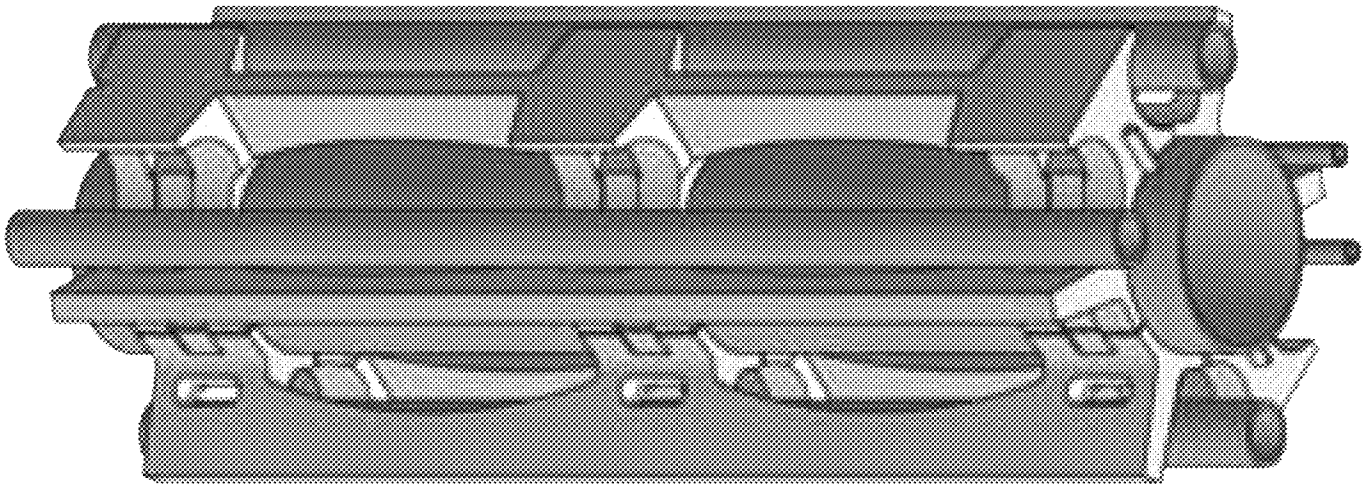
FIG. 10 is a perspective view of an existing drilling riser protection system.
Figure 11:
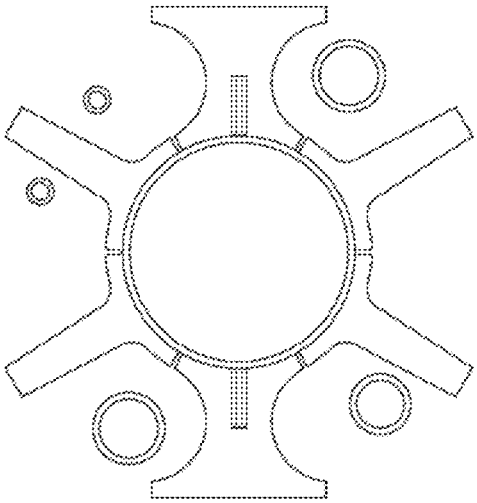
FIG. 11 is a cross-sectional view of the drilling riser protection system shown in FIG. 10.
Figure 12:
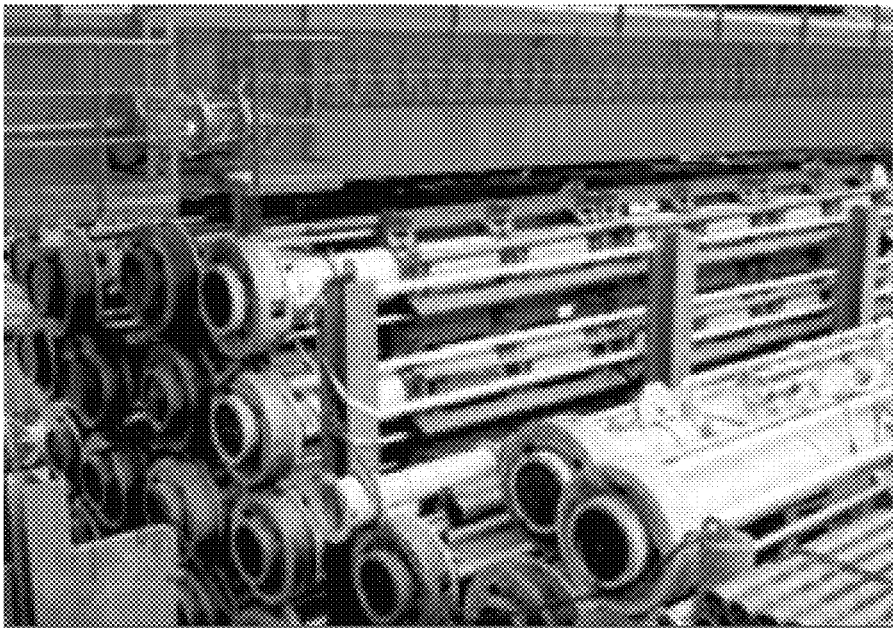
FIG. 12 shows riser joints in a stacked storage.

Any distances between two neighbouring protection modules 12 above a threshold distance may be spanned with one of said cover parts 16 fitted between said two neighbouring modules 12*a*, 12*b*. In particular, any distances between two neighbouring modules 12*a*, 12*b* below said threshold distance may be left uncovered by a cover part 16. The threshold distance may be selected such that a substantially flush finish is achieved along a length of the riser (see FIG. 3) by having throughout the length of the riser 14 protection modules either (i) mutually adjacent or (ii) mutually space with spaces between the protection modules 12 covered with a cover part 16. As shown in FIG. 3, the substantially flush finish may be achieved with a generally circular cross-section such that riser joints 14 can be stacked in the manner shown in FIG. 12, without causing damage to the riser joints 14 and without causing damage to the buoyancy of the riser joints 14. The generally circular cross-section of the marine drilling riser protection system 10 may provide better protection and better stacking ability than existing drilling riser protection systems, for example as shown in FIGS. 10 and 11.

The protection modules 12 may be sized to allow drilling operators to manually remove or add protection modules 12 as required during a drilling campaign without requiring a shore-based dressing operation. More specifically, each of the protection modules may have an axial length approximately the same as an outer diameter of the protection module. Even more specifically, the ratio of the axial length of the protection module 12 to the outer diameter of the protection module 12 may be between 0.5 and 1.5. For example, in the example shown in the drawings, the plan view of the protection module part 20 is generally square (see FIG. 8) such that the axial length of the protection module 12 is in the same general order as the outer diameter of the protection module 12.

Each of the protection modules 12 may be formed as a solid body, without an internal free-flooding cavity. More specifically, in a non-limiting example, each of the protection modules 12 may be formed from a solid material having a density of between 300 kg per cubic meter and 600 kg per cubic meter. In this way, each of the protection modules 12 may provide buoyancy to the riser 14 as the density of sea water is typically around 1,025 kg per cubic meter. The absence of internal free-flooding cavities may facilitate easy movement of the protection modules 12 through sea water with reduced resistance.

Advantageously, the small protection modules 12 provide the ability to stack non buoyed joints vertically on top of one another. These protection modules 12 could typically be made using the same process and materials that existing riser buoyancy modules are made from. The cover parts 16 linking the small protective modules 12 may be made from a tough, resilient, abrasive and impact resistance material such as the material known as Twintex, Aramid, polycarbonate, etc.

It is beneficial that the cover parts 16 mount to the small protection modules 12 and do not need to interface with the riser lines themselves, however there could be a facility to cable tie the cover parts 16 to the riser lines if this provided necessary or advantageous. The result is a flushed finish riser joint (see FIG. 3) that may be stored/stacked to heights similar to joints with buoyancy and a joint that is resistant to the normal damage seen when running or handling their joints. In addition, the small protective modules may be made from the same material or process as existing buoyancy modules. Instead of spanning the gap between protective modules 12 with cover parts 16, the gap could be filled with more of the small buoyancy modules 12. Due to the smaller physical dimensions and weight of these modules 12, they can provide the ability for the drilling operators to remove or add buoyancy modules as required during a drilling campaign, rather than require specialist and bulky handling equipment that typically requires a shore-based dressing operation.

For example, a damaged buoyancy module 12 may be replaced "on the fly" during a drilling campaign resulting in the elimination of whole spare buoyant joints, replaced with a lower quantity of smaller, easily installed, buoyancy modules. An added benefit to the smaller modules 12 is that bending loads imparted by riser deflection into the buoyancy modules and running loads through rotary tables are of a lower magnitude than their normal length equivalents. This means less chance of damage to the equipment. Further, covers could also be fitted along the whole length of buoyant joints to provide an even greater level of protection and act as a sacrificial barrier to running damage. The cover parts 16 may easily be replaced.

Existing protection systems include units which are hollow and must be free-flooding to prevent collapse at depth due to hydrostatic pressures. The free-flooding cavities results in greater loads being imparted into the riser running equipment due to the amount of water that fills the cavities when deployed. The stacking height ability of the existing system shown in FIGS. 10 and 11 may be limited, and the radial fins may be subject to breakage.

Advantageously, the cover parts 16 can be placed over the top of "normal" (existing) buoyancy units to provide a sacrificial protection from running, handling and storage damage.

FIGS. 14 to 21 illustrate another marine drilling riser protection system 110. The system 110 is similarly configured to system 10 and like components have been illustrated with like numbers incremented by 100 where appropriate. The system 110 includes alternatively configured cover parts 116 and protection modules 112, the cover parts having at least one engagement member 144/146/148 which is configured for releasable engagement with the protection modules 112, as will be further described below. Also, the cover parts 116 are configured to receive a securement device 128 which is configured to secure the or each cover part 116 to the protection module and the protection module to the riser.

The cover parts 116 are configured to provide a flushed or generally smooth outer surface which reduces snagging points or hang up points. Furthermore, the protection modules 112 have at least one strap recess 130 formed in and extending around an outer surface or periphery of the protection module 112 (refer FIGS. 15 and 16), though it will be appreciated that two or more recesses may similarly be provided. Also, although the strap recess 130 is shown as being single, continuous and extending completely around the protection module 112, in other embodiments it may not be so configured. For each strap recess 130, the protection modules 112 also have a tensioner recess 132 for receiving tensioner 128. The strap recess 130 is configured to receive corresponding features formed in cover parts 116. In this regard, cover parts 116 also have a strap recess 140 formed in and extending around an outer surface or periphery of the cover part 116, which allows strap 126 to be contained within the extents of the cover part 116 to provide a flushed or generally smooth outer surface and prevent the strap catching on other parts or foreign objects in use.

The protection modules 112 are also formed with a tensioner recess 132 in which tensioner 128, which is provided for tensioning strap 126, can be received. To allow the tensioner 128 to be received in the recess 132, a corresponding aperture 142 is formed in the cover part 116. Aperture 142 and recess 132 together allow tensioner 128 to be received within the extents of the system to also provide a flushed or generally smooth outer surface and protect against the tensioner catching on other parts or foreign objects in use. Also, recesses 130 and 140 cooperate to fix the cover part to the protection module 112 and prevent longitudinal movement of the cover part 116 along the protection module 112 and also the riser 114. Owing to this configuration, the cover parts 116 may be secured to the protection modules 112 at the same time as the protection module is secured to the riser 114, thereby simplifying installation.

As can be seen in FIGS. 16 and 19 to 21, at least part of a peripheral edge or an outer boundary edge of the cover parts is configured to engage a corresponding portion of the protection module(s). In the illustrated embodiment, the cover part 116 is formed with edges 144 and 146 along respective curved and straight edges of the cover part 116, edges 144, 146 being configured for engagement with the protection modules 112. It will be appreciated that edges 144 and 146 may combine to extend around the entire periphery of the cover part 116 or they may only extend around a portion of the periphery. Also, edges 144 and 146 may be formed of a number of tabs or individual returns.

Peripheral edge 144 is formed along a curved edge of each cover part 116 and is configured to follow an outer surface of the protection module 112 to maintain engagement between the cover part 116 and the protection module 112. The peripheral edge 144 may be in the form of a return, lip or a downturned edge and may extend from the cover part 116 at an angle between 30 and 90 degrees. In one example, the edge 144 is formed at an angle of 90 degrees and configured to be received in a recess formed intermediate of the protection module to assist in locating the cover part 116 and the protection module 112. In another example, the angle is 30 degrees and configured to engage an end of the protection module 112, which may be formed with a chamfered edge for cooperation with the peripheral edge 144 to facilitate engagement between the peripheral edge 144 and the protection module 112. In each example, the peripheral edge 144 engages the protection module 112 to further resist relative axial or longitudinal movement between the cover part 116 and the protection module 112.

Disposed along a straight edge or a longitudinally extending portion of the cover part 116 is another edge 146 that is configured for engagement with a portion of the protection module 112. In this regard, edge 146 is formed with a downturned edge or lip and a hooked portion or return 148 that is configured to engage a corresponding longitudinal slot 150 formed in the protection module 112. The hooked portion or return 148 extends longitudinally along and from edge 146 at an angle of approximately 90 degrees to provide a catch. In this regard, edge 146 and return 148 act to releasably fix the cover part to the protection module 112. Preferably, return 148 is configured so that a length of the return 148, i.e. the distance it extends from the edge 146, is greater than a separation between protection modules that are to be fixed together to prevent removal of the return 148 from slot 150 and disengagement of the cover part 116 and the protection module 112 in use.

Figure 20:
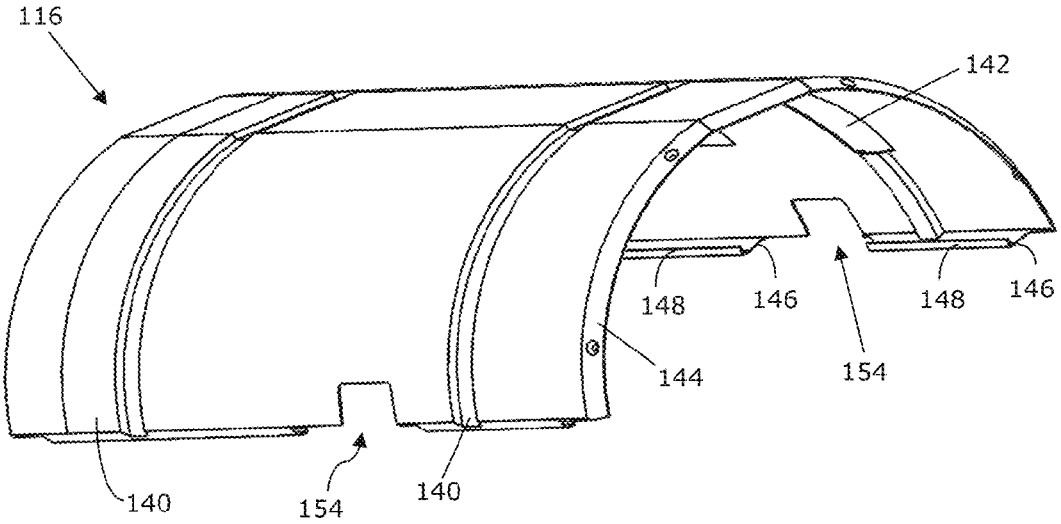
FIG. 20 is a perspective view of an alternative cover part.
Figure 21:
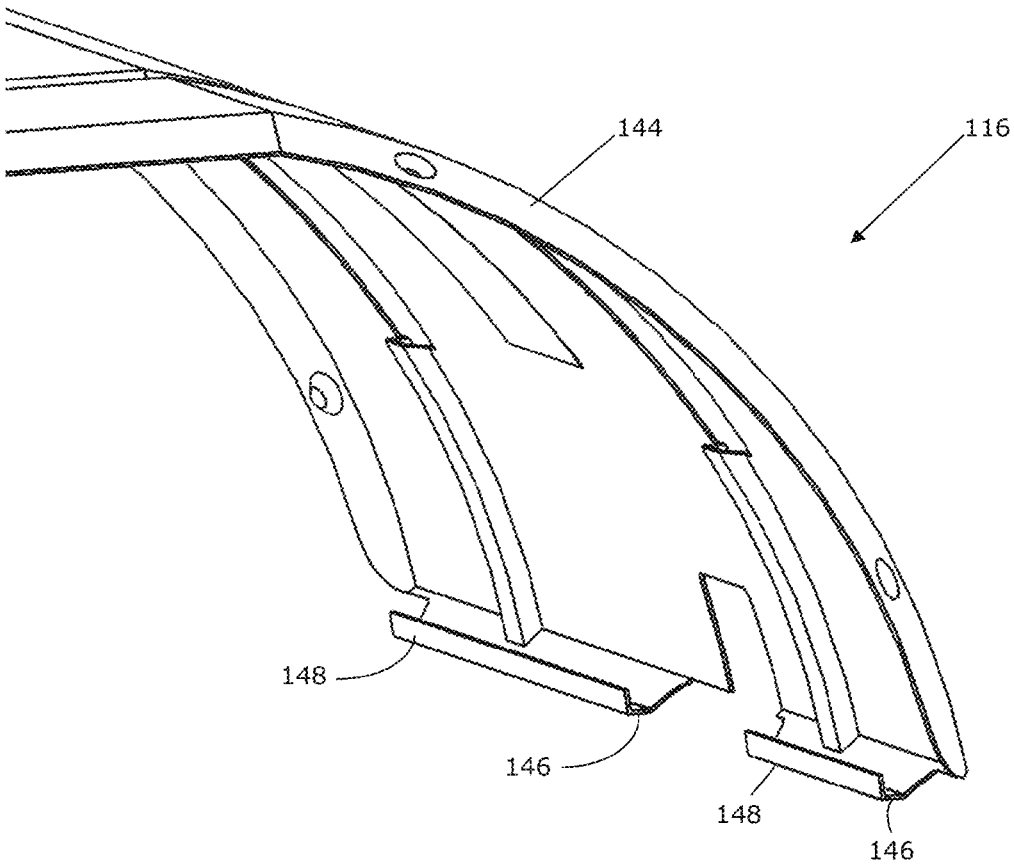
FIG. 21 is a close perspective view of the alternative cover part of FIG. 20.

FIGS. 20 and 21 illustrate an aperture or cutout 154 formed in the cover parts 116, though which the protection module 112 and/or the riser 114 can be viewed/accessed.

Figure 22:
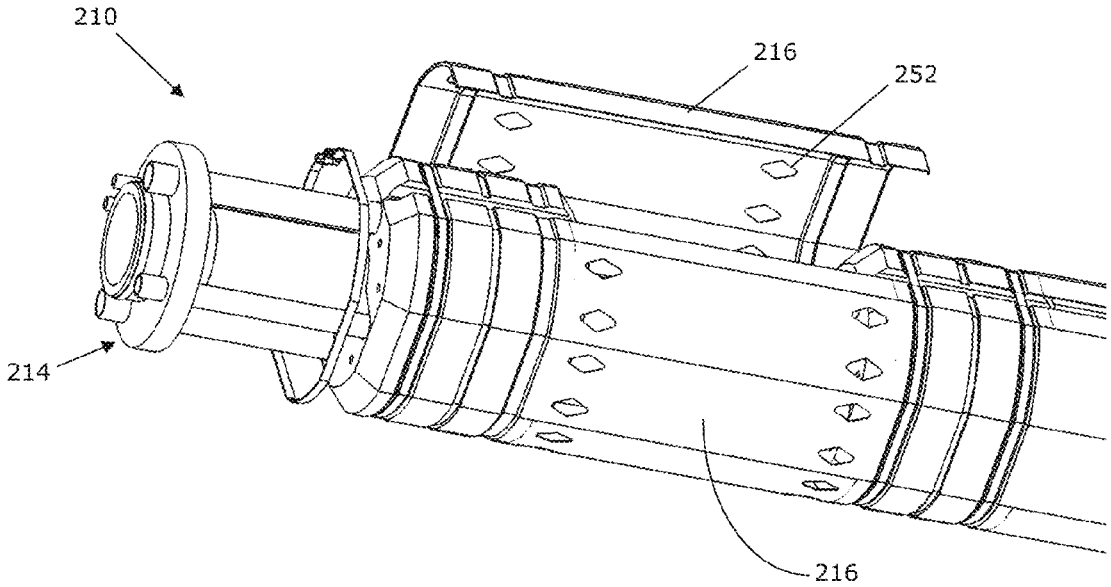
FIG. 22 shows another marine drilling riser protection system fitted to a marine drilling riser.

FIG. 22 illustrates another marine drilling riser protection system 210. The system 110 is similarly configured to systems 10, 110 and like components have been illustrated with like numbers incremented by 100 where appropriate. The system 210 includes alternatively configured cover parts 216 that are provided with a plurality of apertures 252 formed therein to allow for drainage and flooding of a cavity behind the cover part 216 in use. It will be appreciated that it is desirable for the cavity to flood as the system 210 is loaded into the water and also to drain on removal. By providing additional holes as illustrated, flooding and drainage can be completed faster thereby reducing the time taken for installation and removal.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The claims defining the invention are as follows:

1. A marine drilling riser protection system including:

a plurality of protection modules adapted for fitment at spaced intervals along the length of a riser, wherein each of the plurality of protection modules has two recesses extending around an outer surface of the protection module with a first recess of the two recesses located near one end of the protection module and a second of the two recesses located near another end of the protection module; and a plurality of cover parts, wherein each of the plurality of cover parts has two recesses extending around an outer surface of the cover part with a first recess of the two recesses located near one end of the cover part and a second of the two recesses located near another end of the cover part, wherein each cover part is adapted to be fitted at one end of the cover part to a first protection module with the first recess of the cover part received in one of the two recesses of the first protection module, and fitted at an opposite end of the cover part to a second protection module with the second recess of the cover part received in one of the two recesses of the second protection module such that in use the cover part extends across the distance which the first protection module is spaced apart from the second protection module, wherein each cover part is generally semi-cylindrical and has along each longitudinally extending edge a securement device configured for releasable engagement with the protection modules, wherein the securement device formed with an upturned lip sized to extend into a slot formed in a corresponding protection module for locking the cover part to the corresponding protection module when a pair of corresponding cover parts are secured to the corresponding protection module.

2. The marine drilling riser protection system as claimed in claim 1, wherein each of the protection modules is buoyant and the system is adapted to be tailored to a desired buoyancy by attaching protection modules along the riser in greater density of relative location (concentration) to increase buoyancy, and by attaching protection modules along the riser in lower density of relative location (concentration) to decrease buoyancy.

3. The marine drilling riser protection system as claimed in claim 2, wherein each of the protection modules is adapted to be axially fixable to the riser at any location along the length of the riser.

4. The marine drilling riser protection system as claimed in claim 3, wherein each of the protection modules is adapted to be clamped to the riser so as to axially fix the protection module relative to the riser.

5. The marine drilling riser protection system as claimed in claim 1, wherein any distances between two neighbouring protection modules above a threshold distance are spanned with one of said cover parts fitted between said two neighbouring modules and any distances between two neighbouring modules below said threshold distance are left uncovered by a cover part.

6. The marine drilling riser protection system as claimed in claim 5, wherein the threshold distance is selected such that a substantially flush finish is achieved along a length of the riser by having throughout the length of the riser protection modules either (i) mutually adjacent or (ii) mutually spaced with spaces between the protection modules covered with a cover part.

7. The marine drilling riser protection system as claimed in-claim 1, wherein the protection modules are sized to allow drilling operators to manually remove or add protection modules as required during a drilling campaign without requiring a shore-based dressing operation.

8. The marine drilling riser protection system as claimed in claim 7, wherein a ratio of axial length of the protection module to the outer diameter of the protection module is between 0.5 and 1.5.

9. The marine drilling riser protection system as claimed in claim 1, wherein each of the protection modules is formed as a solid body, without an internal free-flooding cavity.

10. The marine drilling riser protection system as claimed in claim 1, wherein each of the cover parts when mounted remains spaced from the riser by the protection modules to which the respective cover part is mounted.

11. The marine drilling riser protection system as claimed in claim 1, wherein at least one of the cover parts has at least one engagement member configured for releasable engagement with the protection modules.

12. The marine drilling riser protection system as claimed in claim 1, wherein the or each cover part is configured to receive a securement device, said device being configured to secure the cover part(s) to the protection module and the protection module to the riser.

13. The marine drilling riser protection system as claimed in claim 12, wherein the or each engagement member is an angled peripheral edge extending from the cover part(s) and configured to engage a corresponding portion of the protection module(s) to fix the cover part to the protection module in use.

14. A marine drilling riser protection system as claimed in claim 1, wherein the protection modules are formed with a tensioner recess in which a tensioner for tensioning the securement strap can be received, the cover parts being formed with an aperture through which the tensioner can be accessed.

15. A marine drilling riser protection system as claimed in claim 1, wherein the lip extends from the cover part a distance which is greater than the separation between the protection modules that are to be fixed together to prevent disengagement of the lip from the protection module when the protection modules are secured together.

16. A marine drilling riser protection system as claimed in claim 1, wherein each of the plurality of protection modules has an outer diameter; each of the plurality of cover parts has an outer diameter; and wherein the outer diameter of each of the plurality of protection modules and the outer diameter of each of the plurality of cover parts is the same such that a substantially flush finish is achieved along a length of the riser.

17. A marine drilling riser protection system including:

a plurality of protection modules adapted for fitment at spaced intervals along the length of a riser; and a plurality of cover parts, wherein each cover part is adapted to be fitted at one end of the cover part to a first protection module, and at an opposite end of the cover part to a second protection module, wherein each cover part is generally semi-circular and has formed along each peripheral edge a securement device configured for releasable engagement with the protection modules, and wherein the protection modules and cover parts are each formed near ends thereof with a recess extending around an outer surface, the recess in the cover parts being configured for receipt of a securement strap and the recess in the protection module being configured for receipt of an underside of the recess formed in the cover part so that the recesses cooperate to fix the cover parts to the protection module, and wherein the protection modules are formed with a tensioner recess in which a tensioner for tensioning the securement strap can be received, the cover parts being formed with an aperture through which the tensioner can be accessed.

* * * * *